US007303028B2

(12) United States Patent
Wu

(10) Patent No.: US 7,303,028 B2
(45) Date of Patent: Dec. 4, 2007

(54) ADJUSTABLE HANDLE FOR A POWER TOOL

(75) Inventor: Hai-Quan Wu, Suzhou (CN)

(73) Assignee: Positec Power Tools (Suzhou) Co., Ltd. (CN)

( * ) Notice: Subject to any disclaimer, the term of this patent is extended or adjusted under 35 U.S.C. 154(b) by 28 days.

(21) Appl. No.: 11/082,300

(22) Filed: Mar. 17, 2005

(65) Prior Publication Data

US 2005/0205277 A1 Sep. 22, 2005

(30) Foreign Application Priority Data

Mar. 18, 2004 (CN) ..... 2004 1 0014373
Mar. 22, 2004 (CN) ..... 2004 1 0014439

(51) Int. Cl.
*B25C 3/08* (2006.01)

(52) U.S. Cl. ..... 173/170; 173/18

(58) Field of Classification Search ..... 173/170, 173/18, 42

See application file for complete search history.

(56) References Cited

U.S. PATENT DOCUMENTS 4,347,450 A 8/1982 Colligan
4,643,263 A 2/1987 Karden
5,161,293 A 11/1992 Ebbert
5,533,581 A 7/1996 Barth et al.
5,737,982 A * 4/1998 Lin ..... 81/58.3
6,000,302 A * 12/1999 Chiang ..... 81/177.8
6,293,859 B1 * 9/2001 Fink et al. ..... 451/344
6,308,599 B1 * 10/2001 Fu-Hui ..... 81/490
6,364,033 B1 * 4/2002 Hung et al. ..... 173/217
6,386,075 B1 * 5/2002 Shiao ..... 81/177.8
6,439,088 B1 * 8/2002 Eytchison et al. ..... 83/13
6,912,790 B2 * 7/2005 James et al. ..... 30/392
6,938,706 B2 * 9/2005 Ng ..... 173/216
2002/0059731 A1 5/2002 Zeiler et al.
2003/0110645 A1 6/2003 Phillips et al.
2003/0200841 A1 10/2003 Novotny
2005/0247466 A1 * 11/2005 Andriolo et al. ..... 173/170
2006/0005401 A1 * 1/2006 Borinato et al. ..... 30/388
2006/0025060 A1 2/2006 Funk

FOREIGN PATENT DOCUMENTS

EP 1 203 628 5/2002
EP 1 314 518 5/2003
EP 1 334 789 A2 8/2003
EP 1574297 A1 * 9/2005

OTHER PUBLICATIONS

International Search Report dated Aug. 5, 2005.
European Search Report dated Aug. 29, 2005.

* cited by examiner

*Primary Examiner*—Brian Nash
(74) *Attorney, Agent, or Firm*—Knobbe Martens Olson & Bear LLP

(57) ABSTRACT

The present invention relates to a power tool comprising: a housing and a handle engaged with the housing, wherein the rear portion of the housing is provided with an arcuate track. The handle is provided with an engaging portion which is engageable with the arcuate track so that the engaging portion of said handle can slide along the track. In this manner, the position of the handle is adjustable relative to the housing. The handle is simple in construction and convenient to use.

12 Claims, 11 Drawing Sheets

ADJUSTABLE HANDLE FOR A POWER TOOL

RELATED APPLICATIONS

This application claims priority to Chinese Application No. 200410014373.0, filed Mar. 18, 2004 and Chinese Application No. 200410014439.6, filed Mar. 22, 2004. Both of these applications are incorporated herein by reference.

BACKGROUND OF THE INVENTION

1. Field of the Invention

The present invention relates to a power tool with an adjustable handle.

2. Description of the Related Art

In order to improve the comfort of using a power tool in different operational states, it is known to make the handle of the power tool angularly adjustable. U.S. Pat. No. 6,588,112 discloses a handle which is adjustable relative to the housing for a circular saw but the handle is complicated constructionally and cannot be used widely. In addition, EP-A-1314518 discloses a power tool in which the housing can pivotally rotate relative to the handle. This is also complicated constructionally.

SUMMARY OF THE INVENTION

It is an object of this invention to provide a power tool with an adjustable handle to overcome certain disadvantages of prior art tools.

Viewed from a first aspect the present invention provides a power tool including:

a housing for mechanical and electrical components of the power tool, wherein an exterior surface of the housing has an elongate mounting portion along which is an arcuate track; and a handle having a distal gripping portion contiguous with a proximal non-gripping portion mounted on the elongate mounting portion of the housing, wherein an outer circumferential surface of the proximal non-gripping portion is provided with an elongate engaging portion arcuately engageable with the arcuate track so that the handle can slide along the arcuate track to allow the orientation of the handle and the housing to be angularly adjustable.

In accordance with an embodiment of the invention, the power tool comprises a housing, a handle engaged with the housing and an arcuate track disposed on a rear mounting portion of the housing. The handle is provided with an engaging portion which is engaged with the arcuate track. The engaging portion of the handle can slide along the track so that the position of the handle is adjustable relative to the housing.

The adjustability of the handle relative to the housing is provided in a simple manner and can be used conveniently.

In a preferred embodiment, the handle is substantially D-shaped and the elongate mounting portion is arcuate, wherein the outer circumferential surface of the proximal non-gripping portion is arcuate to generally match the elongate mounting portion.

Preferably the power tool further comprises:

a locking assembly for selectively interlocking the handle and the housing.

In a preferred embodiment, the locking assembly includes:

an inner hasp pivotally coupled to the elongate mounting portion of the housing at a first position; and an outer hasp pivotally coupled to the elongate mounting portion of the housing at a second position, wherein the first position and second position are spaced apart along the elongate mounting portion and wherein the inner hasp and outer hasp are mutually pivotal between (A) a partially overlapping juxtapositional engagement with the inner circumferential surface of the proximal non-gripping portion whereby to interlock the housing and the handle and (B) a non-overlapping juxtapositional disengagement from the inner circumferential surface of the proximal non-gripping portion whereby the housing and the handle are not interlocked.

Preferably the inner hasp comprises:

a first arcuate plate body terminating at a first end in a cylindrical barrel pivotally coupled to the elongate mounting portion of the housing at the first position by a first connecting pin and incorporating at a second end a laterally extending bore, wherein the cylindrical barrel has a radially projecting cam selectively engageable with a first one of a plurality of locking recesses on the inner circumferential surface of the proximal non-gripping portion of the handle, and wherein the outer hasp comprises:

a second arcuate plate body terminating at a first end in a cylindrical sleeve pivotally coupled to the mounting portion of the housing in the second position by a second connecting pin, wherein the cylindrical sleeve has a second radially projecting cam which is selectively engageable with a second one of the plurality of locking recesses on the inner circumferential surface of the proximal non-gripping portion of the handle.

Preferably the second arcuate plate body deflects along a lateral edge into an arcuate lip which is provided partly along its length with an arcuate sliding slot, wherein a third connecting pin is slidably received in the sliding slot and through the bore of the inner hasp so that the inner hasp is pivotally connected to the outer hasp.

In a preferred embodiment, the locking assembly includes:

a first pressing member at a first position of the elongate mounting portion of the housing;

a second pressing member at a second position of the elongate mounting portion of the housing laterally opposed to the first position;

lateral connecting rods coupling the first pressing member and the second pressing member together so that a part of the proximal non-gripping portion of the handle is captivated by the elongate mounting portion of the housing; and an actuating member adjacent to the surface of the first pressing member, wherein the actuating member is actuatable from (A) a first configuration relative to the first pressing member in which there is effective disengagement of the elongate mounting portion from the outer circumferential surface of the proximal non-gripping portion whereby the housing and the handle are not interlocked to (B) a second configuration relative to the first pressing member in which the first pressing member is inwardly displaced to cause effective engagement of the elongate mounting portion with the outer circumferential surface of the proximal non-gripping portion whereby the housing and the handle are interlocked.

Preferably the power tool further comprises:

one or more coupling pins pivotally coupling the actuating member to a first end of the lateral connecting rods adjacent to the first pressing member, wherein each end of the actuating member comprises an eccentric cam which when the actuating member is in the second configuration inwardly displaces the first pressing member to cause effective engagement of the elongate mounting portion with the outer circumferential surface of the proximal non-gripping portion.

Preferably a clearance is defined between the first pressing member and the second pressing member when the actuating member is in the first configuration.

Preferably the external surface of the eccentric cam lies against the external surface of the first pressing member and wherein the actuating member is actuatatable from the first configuration to the second configuration such that the eccentric cam is rotated eccentrically to push against the first pressing member whereby to cause the first pressing member and the second pressing member to rotate inwardly and distort.

In a preferred embodiment, a part of the inner circumferential surface of the proximal non-gripping portion of the handle is formed with a plurality of parallel mutually spaced apart locking teeth and the locking assembly includes:

a first pressing member at a first position of the elongate mounting portion of the housing;

a second pressing member at a second position of the elongate mounting portion of the housing laterally opposed to the first position;

lateral connecting rods coupling the first pressing member and the second pressing member together so that a part of the proximal non-gripping portion of the handle is captivated by the elongate mounting portion of the housing;

a retractable coupling device fixed at a first end to the first pressing member and at a second end to the second pressing member, wherein the retractable coupling device is formed with a plurality of parallel mutually spaced apart locking bars selectively engageable with the locking teeth; and an actuating member adjacent to the surface of the first pressing member, wherein the actuating member is actuatable from (A) a first configuration in which the retractable coupling device is unretracted so that the locking bars and locking teeth are disengaged whereby the housing and the handle are not interlocked to (B) a second configuration in which the retractable coupling device is retracted so that the locking bars and locking teeth are meshed whereby the housing and the handle are interlocked.

Preferably the power tool further comprises:

one or more coupling pins pivotally coupling the actuating member to a first end of the lateral connecting rods adjacent to the first pressing member, wherein the actuating member is rotational eccentrically from the first configuration to the second configuration so as to push against the retractable coupling device whereby to cause the retractable coupling device to be retracted laterally.

Preferably the retractable coupling device comprises:

a locking block, wherein a first end of the retractable locking block is defined with an axially projecting finger received in and through a receiving slot of the first pressing member and a second end of the locking block opposite to the first end is defined with a receiving bore; and a guiding pin, wherein a first end of the guiding pin is defined by two axially projecting fingers which are slotted in the receiving bore and a second end of the guiding pin is a lateral connecting member which connects the two axially projecting fingers and is captured in a recessed slot of the second pressing member.

Preferably the base of the retractable locking block is formed with the plurality of parallel mutually spaced apart locking bars.

In a preferred embodiment, springs are mounted upon the two axially projecting fingers.

Preferably the outer circumferential surface of the proximal non-gripping portion is provided with an arcuate guiding slot slidably engageable with the arcuate track.

Preferably a part of the inner circumferential surface of the proximal non-gripping portion of the handle is formed with a plurality of parallel mutually spaced apart locking teeth.

Typically the elongate mounting portion and the housing lie in a common plane. Preferably the housing and the handle lie in a common plane. Particularly preferably the orientation of the handle and the housing is angularly adjustable in the common plane.

Preferably the inner circumferential surface of the proximal non-gripping portion has a plurality of locking recesses or teeth. Typically the locking recesses or teeth are parallel and mutually spaced apart. Typically the locking recesses or teeth extend laterally.

The power tool may be a power drill, a reciprocating saw or a planar.

BRIEF DESCRIPTION OF THE DRAWINGS

The features and advantages of preferred embodiments of the present invention may be better understood by reference to the accompanying Figures in which.

DETAILED DESCRIPTION OF THE PREFERRED EMBODIMENT

Figure 1:
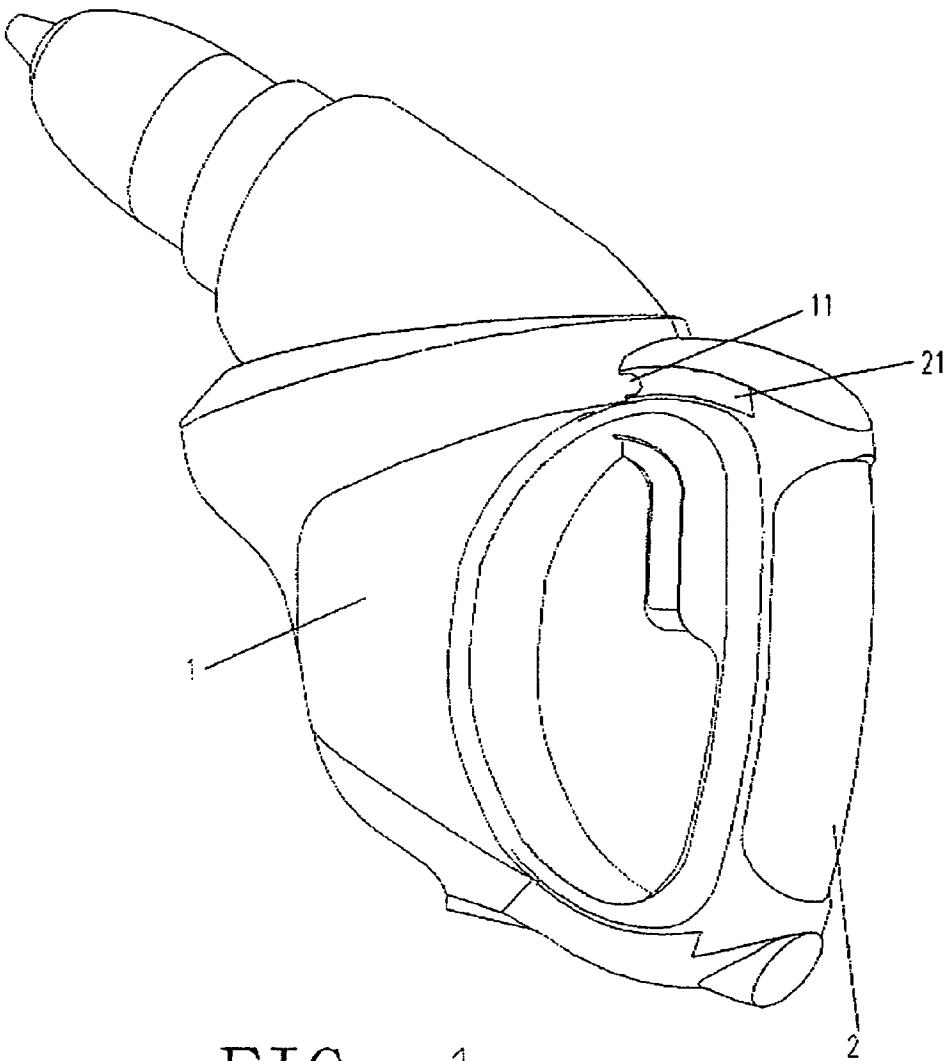
FIG. 1 is a perspective view of a part of a power tool in accordance with an embodiment of the invention.
Figure 2:
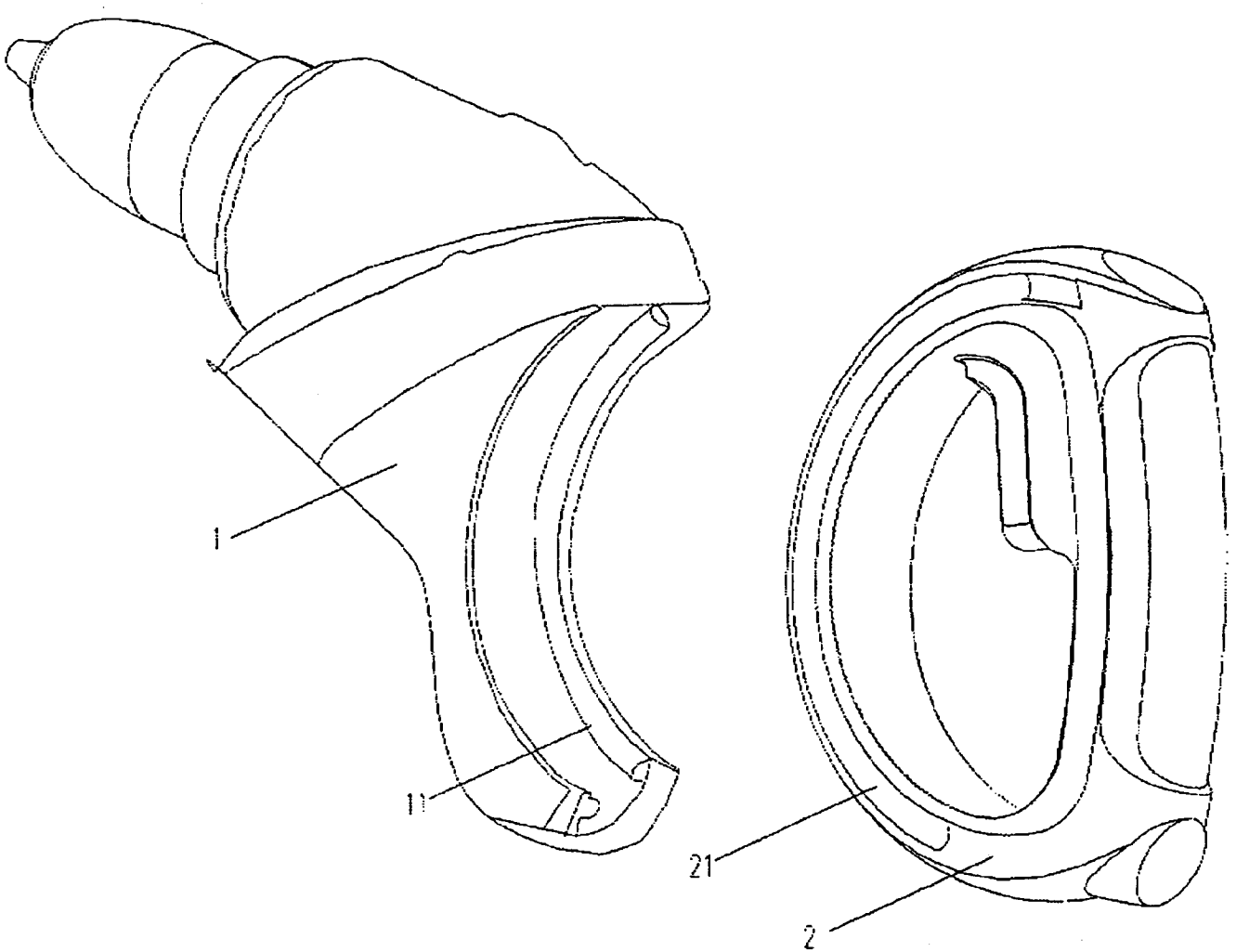
FIG. 2 is an exploded perspective view of a part of the power tool in accordance with the embodiment of the invention.

Referring to FIGS. 1 and 2, a power drill includes generally a housing 1 for the main mechanical and electrical components of the drill (not shown) and a handle 2 mounted on a rear elongate mounting portion of the housing 1 so as to be in a common plane with the housing 1. The handle 2 is substantially D-shaped with a distal gripping portion contiguous with a proximal non-gripping portion. The outer circumferential surface of the proximal non-gripping portion has an arucate configuration which generally matches the arcuate configuration of the rear elongate mounting portion of the housing 1 on which it is mounted.

Each side face of the proximal non-gripping portion is provided with a guiding slot 21. The guiding slot 21 slidably engages an arcuate track 11 defined along the rear elongate mounting portion of the housing 1. The proximal non-gripping portion of the handle 2 can slide along the arcuate track 11 so that the handle 2 is adjustably mounted on the rear elongate mounting portion of the housing 1. This allows the relative orientation of the distal gripping portion and the housing 1 to be angularly adjusted in the common plane for different operations and users.

A locking assembly interlocks the housing 1 to the handle 2 when the desired relative orientation of the distal gripping portion and the housing 1 is achieved. Embodiments of three preferred locking assemblies are described below in their locked and unlocked states.

Figure 3:
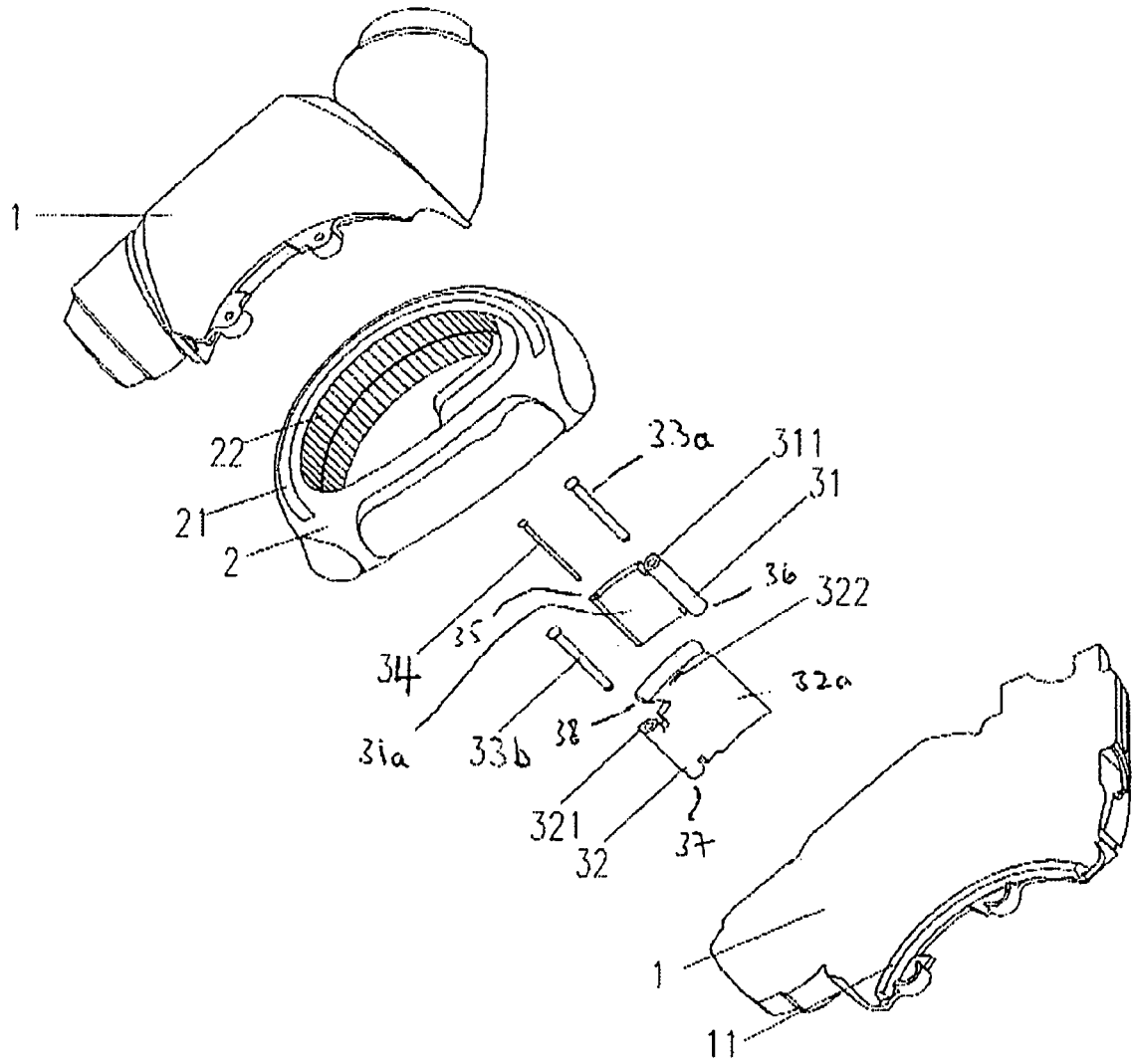
FIG. 3 is an exploded perspective view of a power tool in accordance with an embodiment of the invention illustrating a first preferred locking assembly.
Figure 4:
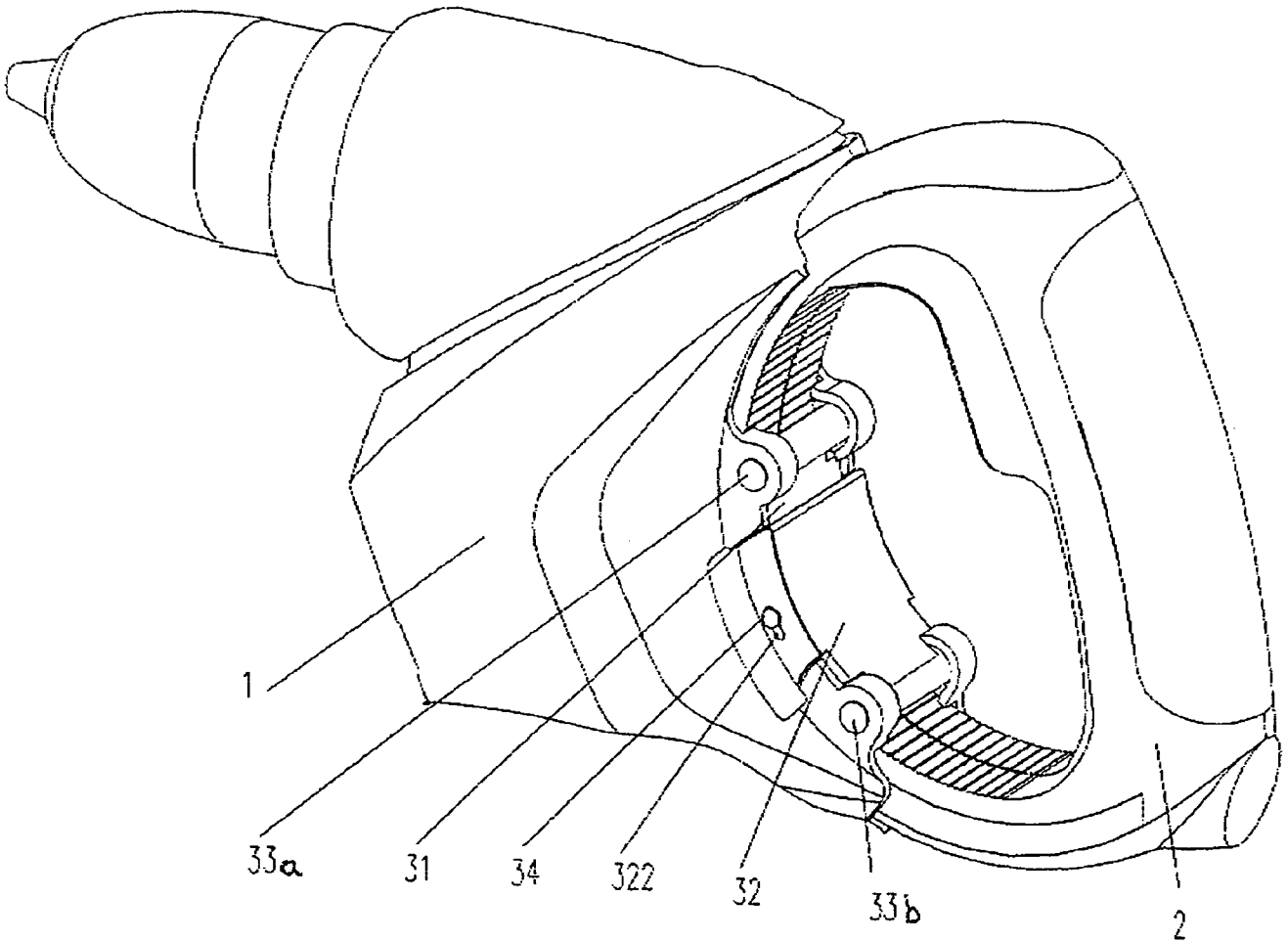
FIG. 4 is a perspective view of the first preferred locking assembly in a locked condition.

Referring to FIGS. 3 and 4, the first preferred locking assembly includes an inner hasp 31 and an outer hasp 32 in juxtapositional overlap or non-overlap. The inner hasp 31 comprises an arcuate plate body 31*a* terminating at a first end in a cylindrical barrel 36 pivotally coupled to the rear mounting portion of the housing 1 perpendicular to the common plane by a first connecting pin 33*a* and incorporating at a second end a laterally extending bore 35. The cylindrical barrel 36 has a radially projecting cam 311 which (in the locking state) selectively engages one of a plurality of locking recesses 22 on the inner circumferential surface of the proximal non-gripping portion of the handle 2. The outer hasp 32 comprises an arcuate plate body 32*a* terminating at a first end in a cylindrical sleeve 37 pivotally coupled to the rear mounting portion of the housing 1 perpendicular to the common plane by a second connecting pin 33*b*. The cylindrical sleeve 37 has a radially projecting cam 321 which (in the locking state) selectively engages one of the plurality of locking recesses 22 on the inner circumferential surface of the proximal non-gripping portion of the handle 2.

The arcuate plate body 32*a* deflects along a lateral edge into an arcuate lip 38 which is provided partly along its length with an arcuate sliding slot 322. A second connecting pin 34 is slidably received in the sliding slot 322 and through the bore 35 of the inner hasp 31 so that the inner hasp 31 is pivotally connected to the outer hasp 32. The connecting pin 34 can slide along the axis of the sliding slot 322.

Figure 5:
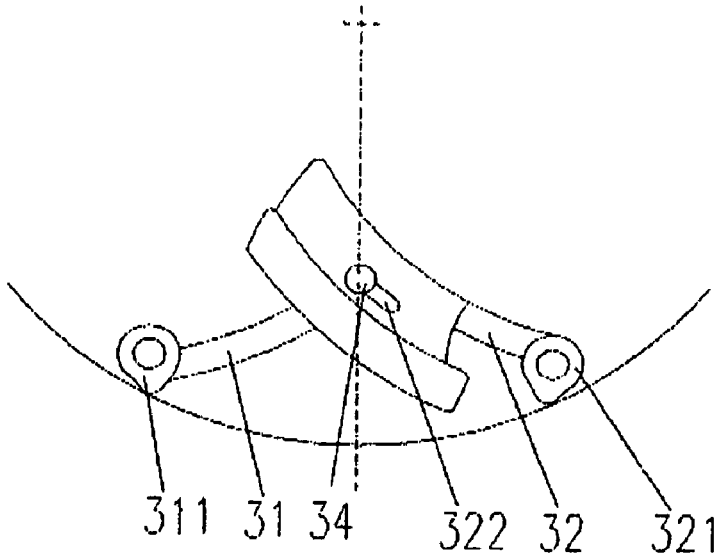
FIG. 5 is a schematic view of the first preferred locking assembly in an unlocked condition.
Figure 6:
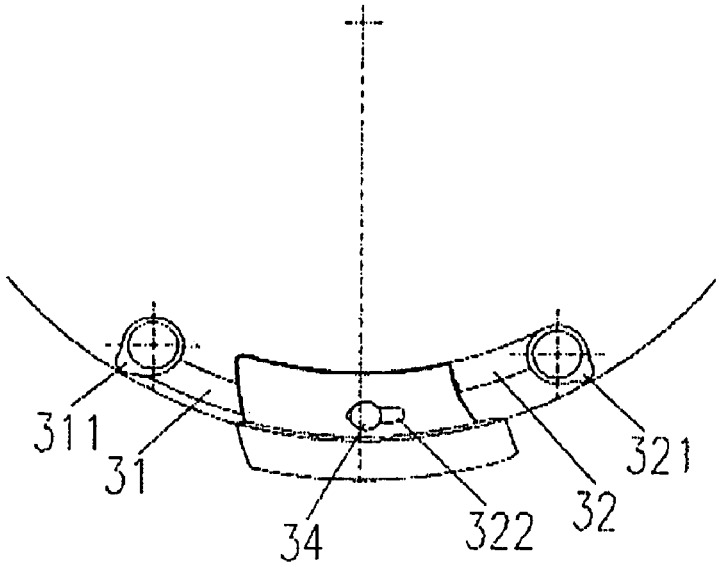
FIG. 6 is a schematic view of the first preferred locking assembly in a locked condition.

Referring to FIG. 5, in the unlocked state the connecting pin 34 is located at a first end of the sliding slot 322. The cams 311 and 321 are disengaged from the locking recesses 22 and so the handle 2 is free to slide along the arcuate track 11. To achieve the locked state (see FIG. 6), the outer hasp 31 is depressed to cause the second connecting pin 34 to slide towards a second end of the sliding slot 322 and to pivot the inner hasp 31. Simultaneously the cam 311 and 321 are rotated into engagement with the locking recesses 22 to interlock the handle 2 and the housing 1.

Figure 7:
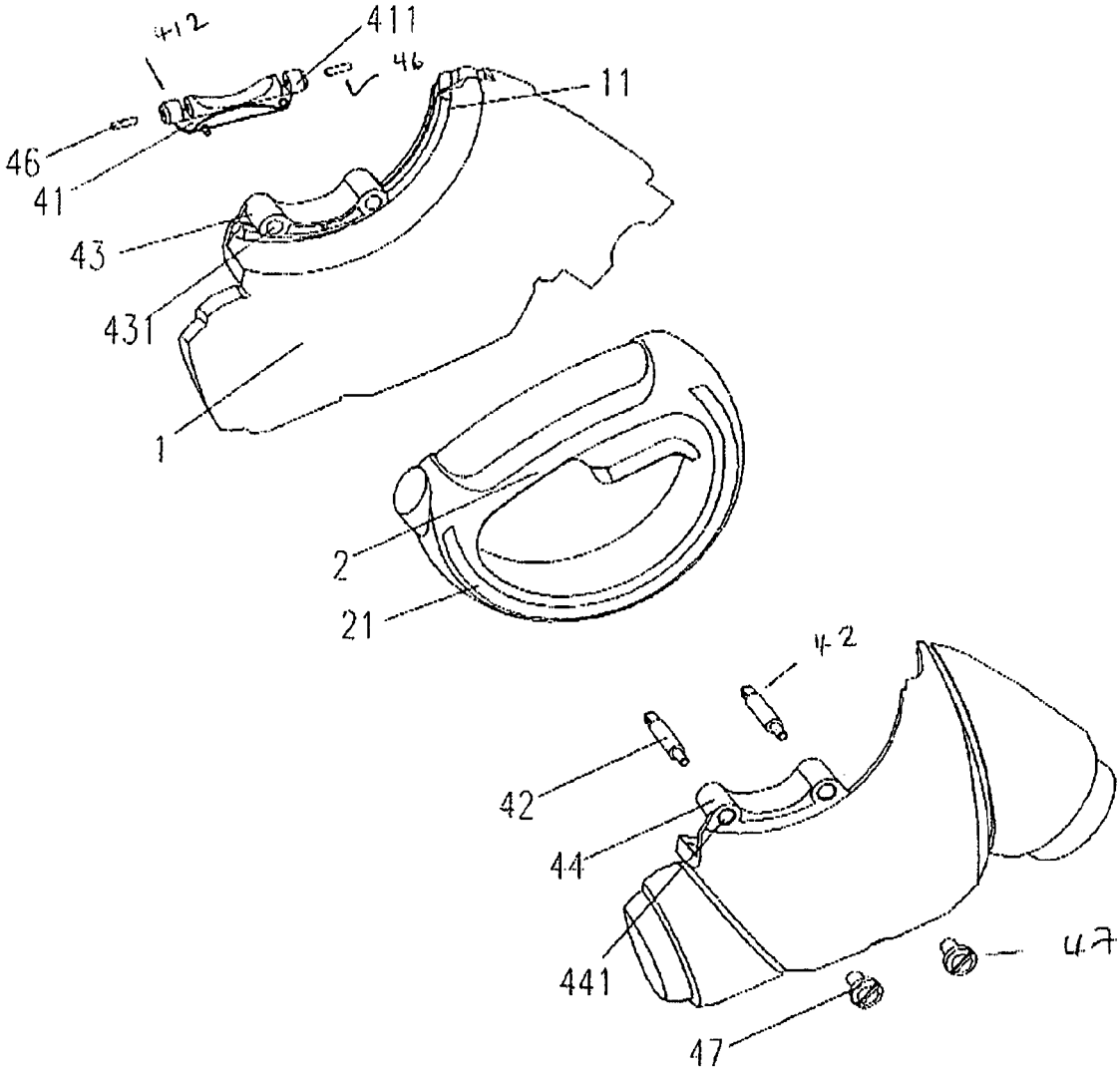
FIG. 7 is an exploded perspective view of a power tool in accordance with an embodiment of the invention illustrating a second preferred locking assembly.
Figure 8:
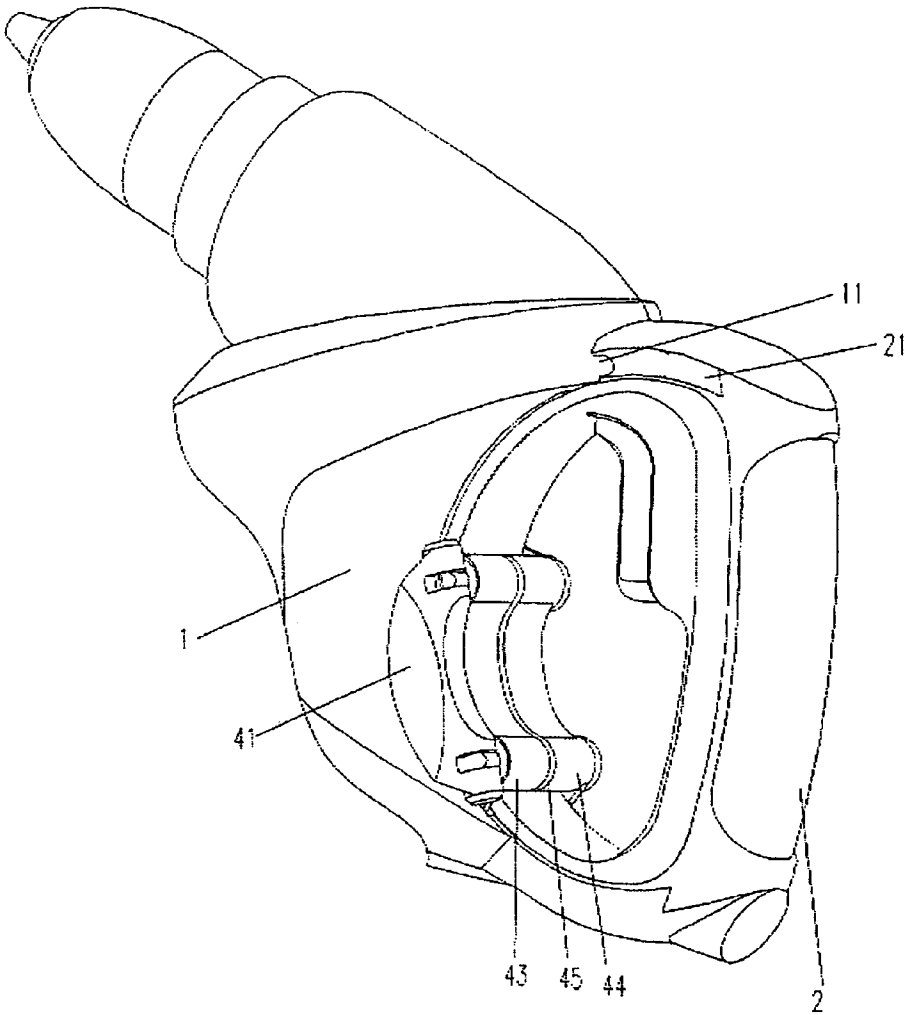
FIG. 8 is a perspective view of the second preferred locking assembly in a locked condition.

Referring to FIGS. 7 and 8, the second preferred locking assembly includes generally an actuating member 41, connecting rods 42, a first pressing member 43 on a first portion of the housing 1 and a second pressing member 44 on a second portion of the housing 1 opposite to the first portion. The first pressing member 43 is provided with first bores 431 and the second pressing member 44 is provided with second bores 441 which are collinear with the first bores 431. The connecting rods 42 extend through the first bores 431 and the second bores 441 so that the first pressing member 43 and the second pressing member 44 together with the remainder of the housing 1 encapsulate a receiving space for captivating a part of the proximal non-gripping portion of the handle 2. Coupling pins 46 pivotally couple the actuating member 41 to the first ends of the connecting rods 42 adjacent to the first pressing member 43 and the second ends of the connecting rods 42 are fastened to the second pressing member 44 by the nuts 47. Each end of the actuating member 41 is provided with an eccentric cam 411 and 412 respectively.

Figure 9:
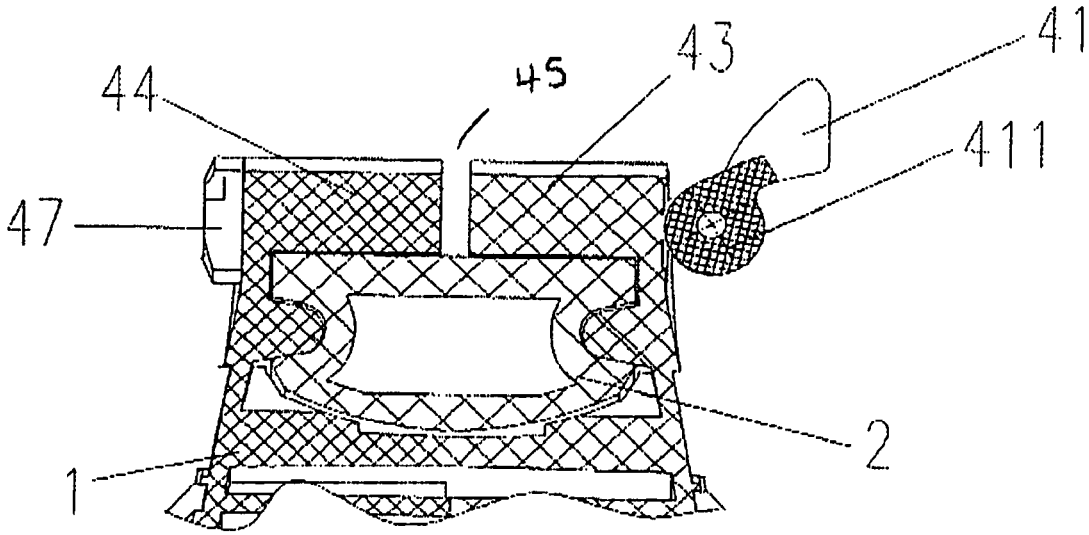
FIG. 9 is a partial cross-sectional view of the second preferred locking assembly in an unlocked condition.
Figure 10:
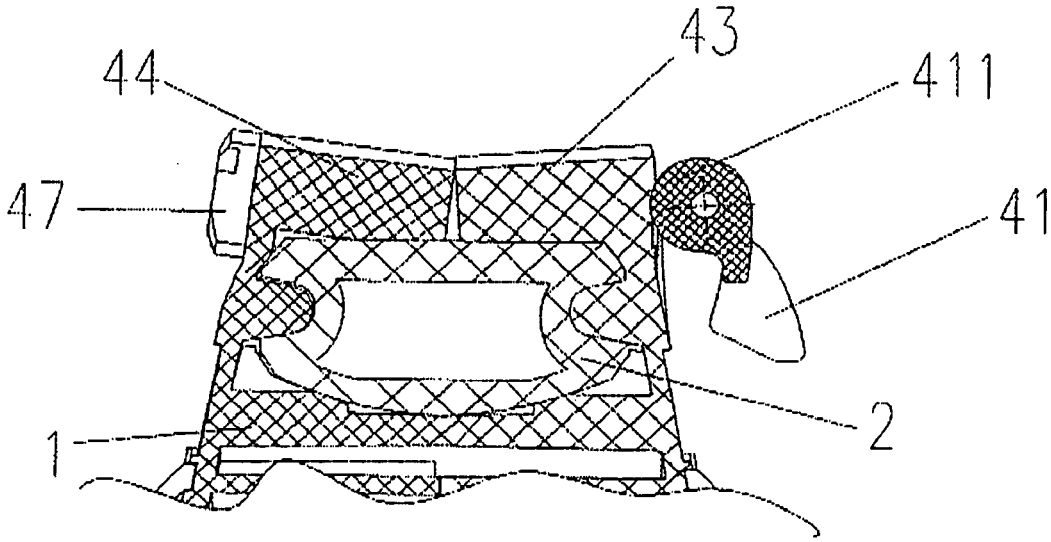
FIG. 10 is a partial cross-sectional view of the second preferred locking assembly in a locked condition.

Referring to FIG. 9, in an unlocked state a portion of the handle 2 is snugly captivated by the housing 1 and a clearance 45 is defined between the first pressing member 43 and the second pressing member 44 so that the housing 1 and handle 2 are not interlocked. The external surface of the eccentric cam 411 lies against the external surface of the first pressing member 43. To achieve a locked state (see FIG. 10), the actuating member 41 is actuated so that the eccentric cam 411 is rotated eccentrically to displace the first pressing member 43. The first pressing member 43 and the second pressing member 44 rotate inwardly and distort so that the handle 2 is pressed downwardly against the housing 1. This means that the clearance 45 is closed and the handle 2 and the housing 1 are interlocked.

Figure 11:
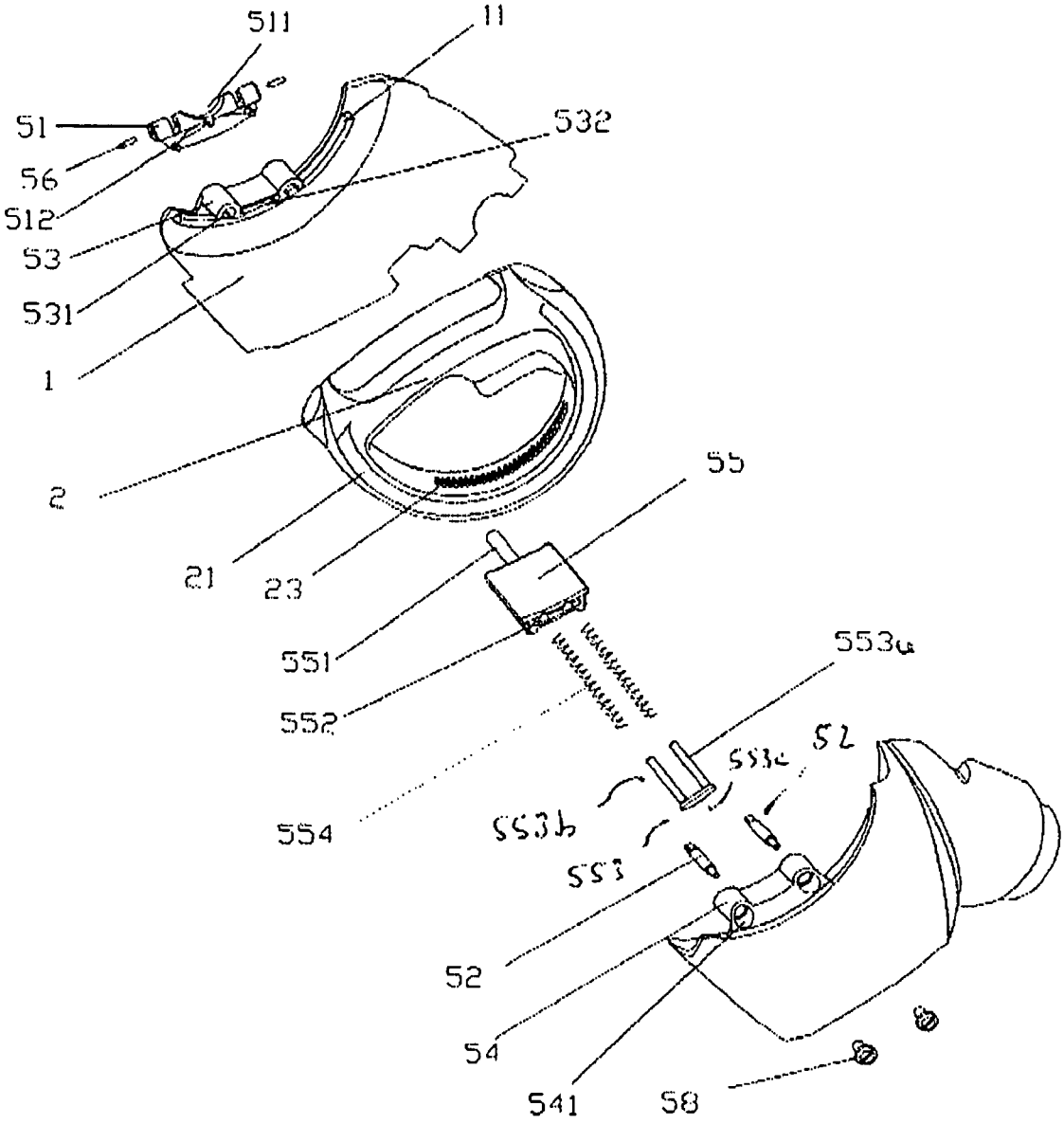
FIG. 11 is an exploded perspective view of a power tool in accordance with an embodiment of the invention illustrating a third preferred locking assembly.
Figure 12:
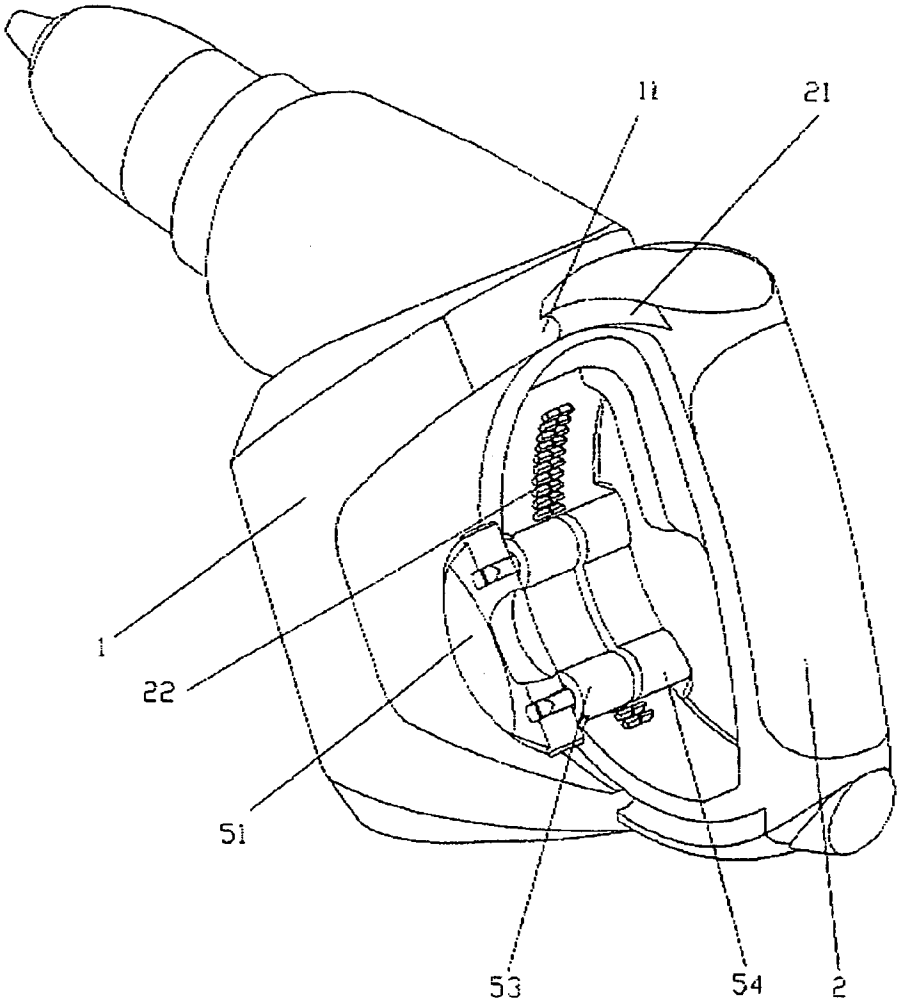
FIG. 12 is a perspective view of the third preferred locking assembly in a locked condition.

Referring to FIGS. 11 and 12, the third preferred locking assembly includes generally an actuating member 51, connecting rods 52, a first pressing member 53 on a first portion of the housing 1, a second pressing member 54 on a second portion of the housing 1 opposite to the first portion, a retractable locking block 55, a guiding pin 553 and springs 554. The first pressing member 53 is provided with first bores 531 and the second pressing member 54 is provided with second bores 541 which are collinear with the first bores 531. The connecting rods 52 extend through the first bores 531 and the second bores 541 so that the first pressing member 53 and the second pressing member 54 together with the remainder of the housing 1 encapsulate a receiving space for captivating a part of the proximal non-gripping portion of the handle 2. Coupling pins 56 pivotally couple the actuating member 51 to the first ends of the connecting rods 52 adjacent to the first pressing member 53 and the second ends of the connecting rods 52 are fastened to the second pressing member 54 by the nuts 58. The middle of the actuating member 51 defines a recessed portion 511. An embossed portion 512 extends from the base of the recessed portion 511.

A first end of the retractable locking block 55 is defined with an axially projecting finger 551 received in a receiving slot 532 between the first bores 531 of the first pressing member 53 and a second end of the locking block 55 opposite to the first end is defined with a receiving bore 552. A first end of the guiding pin 553 is defined by two axially projecting fingers 553*a*, 553*b* upon which are mounted springs 554 and which are slotted in the receiving bore 552. A second end of the guiding pin 553 is a lateral connecting member 553*c* which connects the two axially projecting fingers 553*a*, 553*b* and is captured in a recessed slot (not shown) of the second pressing member 54.

Figure 13:
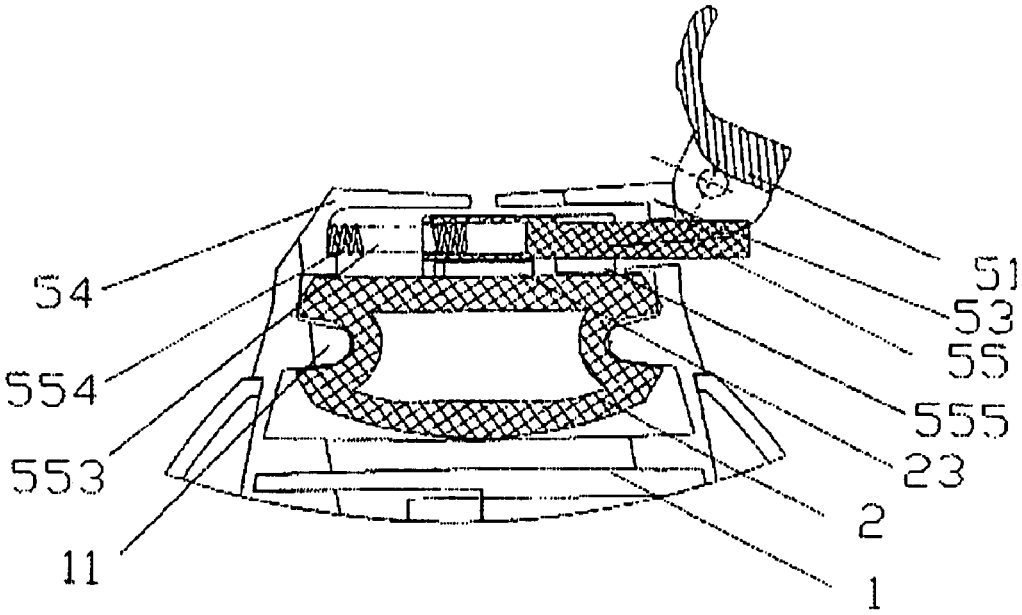
FIG. 13 is a partial cross-section view of the third preferred locking assembly in an unlocked condition.

The base of the retractable locking block 55 is formed with a plurality of parallel mutually spaced apart locking bars 555 (as shown in FIG. 13). The opposing part of the proximal non-gripping portion of the handle 2 is formed with a plurality of parallel mutually spaced apart locking teeth 23 with which the locking bars 555 are selectively engageable.

Figure 14:
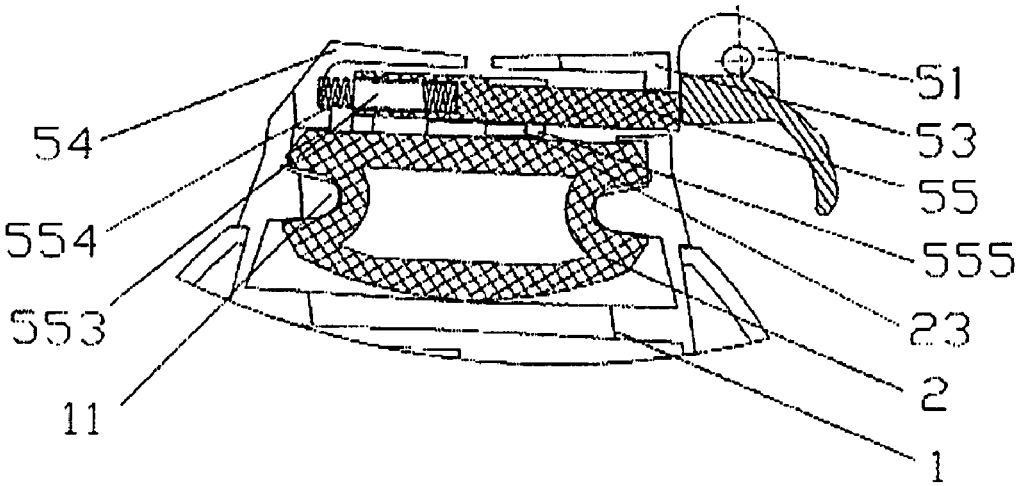
FIG. 14 is a partial cross-section view of the third preferred embodiment in a locked condition.

Referring to FIG. 13, in an unlocked state the recessed portion 511 is seated adjacent the receiving slot 532 and the locking bars 555 are disengaged from the locking teeth 23. To achieve a locked state (see FIG. 14), the actuating member 51 is rotated so that the embossed member 512 engages and retracts the axially projecting finger 551 against the action of the springs 554 so that the locking bars 555 mesh with the locking recesses 23 to interlock the housing 1 and the handle 2.

What is claimed is:

1. A power tool comprising:

a housing for mechanical and electrical components of the power tool, wherein an exterior surface of the housing has an elongate mounting portion along which is an arcuate track;

a handle having a distal gripping portion contiguous with a proximal non-gripping portion mounted on the elongate mounting portion of the housing, wherein an outer circumferential surface of the proximal non-gripping portion is provided with an elongate engaging portion arcuately engageable with the arcuate track so that the handle can slide along the arcuate track to allow the orientation of the handle and the housing to be angularly adjustable; and a locking assembly for selectively interlocking the handle and the housing, wherein the locking assembly comprises:

an inner hasp pivotally coupled to the elongate mounting portion of the housing at a first position; and an outer hasp pivotally coupled to the elongate mounting portion of the housing at a second position, wherein the first position and second position are spaced apart along the elongate mounting portion and wherein the inner hasp and outer hasp are mutually pivotal between (A) a partially overlapping juxtapositional engagement with the inner circumferential surface of the proximal non-gripping portion whereby to interlock the housing and the handle and (B) a non-overlapping juxtapositional disengagement from the inner circumferential surface of the proximal non-gripping portion whereby the housing and the handle are not interlocked.

2. The power tool as defined in claim 1 wherein the inner hasp comprises:

a first arcuate plate body terminating at a first end in a cylindrical barrel pivotally coupled to the elongate mounting portion of the housing at the first position by a first connecting pin and incorporating at a second end a laterally extending bore, wherein the cylindrical barrel has a radially projecting cam selectively engageable with a first one of a plurality of locking recesses on the inner circumferential surface of the proximal non-gripping portion of the handle, and wherein the outer hasp comprises:

a second arcuate plate body terminating at a first end in a cylindrical sleeve pivotally coupled to the mounting portion of the housing in the second position by a second connecting pin, wherein the cylindrical sleeve has a second radially projecting cam which is selectively engageable with a second one of the plurality of locking recesses on the inner circumferential surface of the proximal non-gripping portion of the handle.

3. The power tool as defined in claim 2 wherein the second arcuate plate body deflects along a lateral edge into an arcuate lip which is provided partly along its length with an arcuate sliding slot, wherein a third connecting pin is slidably received in the sliding slot and through the bore of the inner hasp so that the inner hasp is pivotally connected to the outer hasp.

4. A power tool comprising:

a housing for mechanical and electrical components of the power tool, wherein an exterior surface of the housing has an elongate mounting portion along which is an arcuate track;

a handle having a distal gripping portion contiguous with a proximal non-gripping portion mounted on the elongate mounting portion of the housing, wherein an outer circumferential surface of the proximal non-gripping portion is provided with an elongate engaging portion arcuately engageable with the arcuate track so that the handle can slide along the arcuate track to allow the orientation of the handle and the housing to be angularly adjustable; and a locking assembly for selectively interlocking the handle and the housing, wherein the locking assembly comprises:

a first pressing member at a first position of the elongate mounting portion of the housing;

a second pressing member at a second position of the elongate mounting portion of the housing laterally opposed to the first position;

lateral connecting rods coupling the first pressing member and the second pressing member together so that a part of the proximal non-gripping portion of the handle is captivated by the elongate mounting portion of the housing; and an actuating member adjacent to the surface of the first pressing member, wherein the actuating member is actuatable from (A) a first configuration relative to the first pressing member in which there is effective disengagement of the elongate mounting portion from the outer circumferential surface of the proximal non-gripping portion whereby the housing and the handle are not interlocked to (B) a second configuration relative to the first pressing member in which the first pressing member is inwardly displaced to cause effective engagement of the elongate mounting portion with the outer circumferential surface of the proximal non-gripping portion whereby the housing and the handle are interlocked.

5. The power tool as defined in claim 4 further comprising one or more coupling pins pivotally coupling the actuating member to a first end of the lateral connecting rods adjacent to the first pressing member, wherein each end of the actuating member comprises an eccentric cam which when the actuating member is in the second configuration inwardly displaces the first pressing member to cause effective engagement of the elongate mounting portion with the outer circumferential surface of the proximal non-gripping portion.

6. The power tool as defined in claim 5 wherein the external surface of the eccentric cam lies against the external surface of the first pressing member and wherein the actuating member is actuatable from the first configuration to the second configuration such that the eccentric cam is rotated eccentrically to push against the first pressing member whereby to cause the first pressing member and the second pressing member to rotate inwardly and distort.

7. The power tool as defined in claim 4 wherein a clearance is defined between the first pressing member and the second pressing member when the actuating member is in the first configuration.

8. A power tool comprising:

a housing for mechanical and electrical components of the power tool, wherein an exterior surface of the housing has an elongate mounting portion along which is an arcuate track;

a handle having a distal gripping portion contiguous with a proximal non-gripping portion mounted on the elongate mounting portion of the housing, wherein an outer circumferential surface of the proximal non-gripping portion is provided with an elongate engaging portion arcuately engageable with the arcuate track so that the handle can slide along the arcuate track to allow the orientation of the handle and the housing to be angularly adjustable; and a locking assembly for selectively interlocking the handle and the housing, wherein a part of the inner circumferential surface of the proximal non-gripping portion of the handle is formed with a plurality of parallel mutually spaced apart locking teeth and the locking assembly comprises:

a first pressing member at a first position of the elongate mounting portion of the housing;

a second pressing member at a second position of the elongate mounting portion of the housing laterally opposed to the first position;

lateral connecting rods coupling the first pressing member and the second pressing member together so that a part of the proximal non-gripping portion of the handle is captivated by the elongate mounting portion of the housing;

a retractable coupling device fixed at a first end to the first pressing member and at a second end to the second pressing member, wherein the retractable coupling device is formed with a plurality of parallel mutually spaced apart locking bars selectively engageable with the locking teeth; and an actuating member adjacent to the surface of the first pressing member, wherein the actuating member is actuatable from (A) a first configuration in which the retractable coupling device is unretracted so that the locking bars and locking teeth are disengaged whereby the housing and the handle are not interlocked to (B) a second configuration in which the retractable coupling device is retracted so that the locking bars and locking teeth are meshed whereby the housing and the handle are interlocked.

9. The power tool as defined in claim 8 further comprising one or more coupling pins pivotally coupling the actuating member to a first end of the lateral connecting rods adjacent to the first pressing member, wherein the actuating member is rotational eccentrically from the first configuration to the second configuration so as to push against the retractable coupling device whereby to cause the retractable coupling device to be retracted laterally.

10. The power tool as defined in claim 8 wherein the retractable coupling device comprises:

a locking block, wherein a first end of the retractable locking block is defined with an axially projecting finger received in and through a receiving slot of the first pressing member and a second end of the locking block opposite to the first end is defined with a receiving bore; and a guiding pin, wherein a first end of the guiding pin is defined by two axially projecting fingers which are slotted in the receiving bore and a second end of the guiding pin is a lateral connecting member which connects the two axially projecting fingers and is captured in a recessed slot of the second pressing member.

11. The power tool as defined in claim 10 wherein the base of the retractable locking block is formed with the plurality of parallel mutually spaced apart locking bars.

12. The power tool as defined in claim 10 wherein springs are mounted upon the two axially projecting fingers.

* * * * *